United States Patent [19]

Mullen

[11] Patent Number: 4,876,927

[45] Date of Patent: Oct. 31, 1989

[54] DOOR OPENING APPARATUS AND METHOD OF USING SAME

[76] Inventor: Robert S. Mullen, P.O. Box 4533, Hayward, Calif. 94544

[21] Appl. No.: 278,590

[22] Filed: Dec. 1, 1988

[51] Int. Cl.[4] ..... B25B 33/00

[52] U.S. Cl. ..... 81/15.9

[58] Field of Search ..... 81/15.9, 64, 177.1, 81/3.4, 488; 70/465

[56] References Cited

U.S. PATENT DOCUMENTS

| | | | |
|---|---|---|---|
| 2,235,313 | 3/1941 | Cleveland | 81/3.4 |
| 3,664,211 | 5/1972 | McConnell | 81/3 R |
| 4,048,873 | 9/1977 | Stevens | 81/3 R |
| 4,079,642 | 3/1978 | Scott | 81/64 |
| 4,144,778 | 3/1979 | Waring | 81/3 R |
| 4,252,218 | 2/1981 | Cowardin | 70/465 |
| 4,563,920 | 1/1986 | Ingersoll | 81/177.8 |
| 4,608,886 | 9/1986 | Bolton | 81/15.9 |
| 4,655,102 | 4/1987 | Parkins | 81/15.9 |

*Primary Examiner*—Roscoe V. Parker

*Attorney, Agent, or Firm*—Douglas A. Chaikin

[57] ABSTRACT

Disclosed herein is a the door opening apparatus and method of using same which includes a rigid member, a flexible patch member suspended on the rigid member having an area for grasping a door knob and the like and control lines connected to the patch member for moving the patch relative the rigid member. The upper section of the rigid member defines a frame. The flexible patch member has openings at its corners. Elastic and non-elastic supports are threaded through the openings and connected to the frame for suspending the patch member on the frame in balanced relationship thereto. Two control lines are threaded through two of the openings for moving the flexible patch and for unbalancing same.

16 Claims, 2 Drawing Sheets

DOOR OPENING APPARATUS AND METHOD OF USING SAME

BACKGROUND OF THE INVENTION:

1. Field of the Invention:

This invention relates to mechanical devices for opening locked doors having door handles and more particularly to reusable such devices which require a minimal amount of skill to use.

Modern technology is producing electronic door locks that do not use keys, but rather work on various means of electronic combination recognition. When these locks fail to work, standard locksmith method are virtually useless. In order to open the door with the failed lock, a physical assault on either the lock or the door must be used to gain access.

Examples repeesenting the state of the art in door opening devices include Scott, U.S. Pat. No. 4,079,642 which discloses strap wrench including a sliding or wrenching strap portion being secured by one end to a buckle and formed into a bight; Stevens, U.S. Pat. No. 4,048,873 for a door security lock opening tool and method of using same which discloses a U-shaped member including an actuating leg and a handle leg interconnected by a base portion; Waring, U.S. Pat. No. 4,144,778 for a tool for lifting a latch operator of a locked vehicle door which discloses a strip of spring steel bent back upon itself defining a first long operator leg and a second normally diverging shorter latch manipulator leg; McConnell, U.S. Pat. No. 3,664,211 for a vehicle door lock release and method and apparatus which discloses an elongate member arranged for downward insertion into a vehicle door between the door glass and window sill and arranged to engage a portion of the door lock assembly and trip the lock; Bolton, U.S. Pat. No. 4,608,886 for keyless door unlocking apparatus for automobiles which discloses an elongate rod being bent about 90° at the lower end to form a sidewardly projecting arm; and Parkins, U.S. Pat. No. 4,655,102 for a locksmith tool for unlocking motor vehicle doors which discloses another elongate probing tool and which includes a sawtooth member. Also known is a wrench to Ingersoll, U.S. Pat. No. 4,563,920 which discloses a rigid handle having loosely removable interconnected portions and a flexible handle member.

However what has gone unrecognized by the above is that most door locks secure the door from only one side, namely the outside. Recognizing the fact doors are usually not secured from the inside, it is clearer that what is needed is a door opening apparatus which allows the door to be opened from the outside by delivering a door opening mechanism to the inside. The need for such a door opening mechanism would be still greater if the door could be opened without damage to either it or the mechanism itself. A reusable such mechanism would fill a great need in this field.

SUMMARY OF THE INVENTION

It is an object of this invention to provide an apparatus which is capable of opening locked doors having door handles from the outside without damage to the door.

It is a further object of this invention to provide a mechanically simple apparatus that is capable of opening from the outside sophisticated electronically locked doors that have no keys.

It is a further object of this invention to provide an easy to use and reusable door opening apparatus that will open locked doors from the outside.

In accordance with the above objects and those that will be mentioned and will become apparent below, the door opening apparatus in accordance with this invention, comprises:

- a flexible patch having means for grasping the door handle;
- an elongated rigid member having a top portion defining a frame having at least three sides, the flexible patch suspended within the frame and in balanced relation thereto; and
- means connected to the patch for unbalancing the patch on the frame and for translating linear movement of the patch into rotational movement of the door handle.

In a preferred embodiment the grasping means comprises a patch of material such as urethane, which has a high co-efficient of friction. Although it is believed that any flexible material having a high co-efficient of friction would be suitable. The grasping patch is adhered to the flexible patch in the upper third and preferably extends the width of the flexible patch.

The preferred rigid member also has a bent middle portion and a handle for adjusting and shifting the door opening apparatus in accordance with this invention to a location adjacent the door handle.

It is further preferred to suspend the flexible patch such that it is approximately equi-distant from the inside edges of the frame. Also preferred is to suspend the flexible patch by means of elastic supports. And it is further preferred to suspend the flexible patch such that it is spread out, using non-elastic supports connected to the frame and the bottom portion of the flexible patch.

It is an advantage of this invention to a provide a door opening apparatus which is capable of opening doors having a wide variety of different types of door handles.

It is an additional advantage of this invention to provide a door opening apparatus which can open right or left hand door with similar ease.

BRIEF DESCRIPTION OF THE DRAWING:

For a further understanding of the objects and advantages of the present invention, reference should be had to the following detailed description, taken in conjunction with the accompanying drawing, in which like parts are given like reference numerals and wherein.

DETAILED DESCRIPTION OF THE INVENTION

Two of the many uses of the door opening apparatus in accordance with this invention will be described in detail below. The invention will be described with reference to a round-type door handle and a lever-type door handle. It will be appreciated that one of the advantages of this invention is that is adaptable for use with a wide variety of different door handles with great ease and efficiency.

Figure 1:
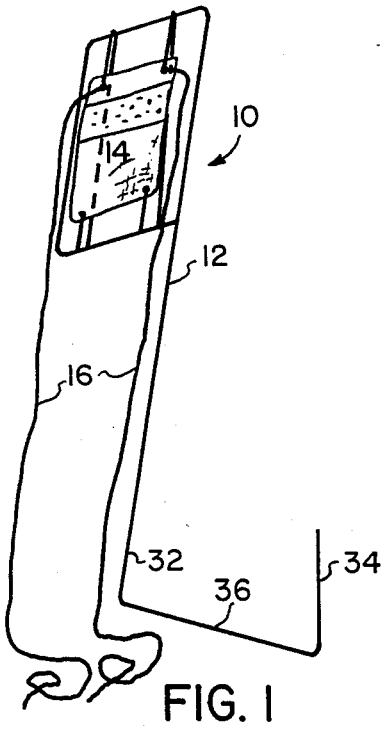
FIG. 1 is an elevated perspective plan view of the door opening apparatus in accordance with this invention.
Figure 2:
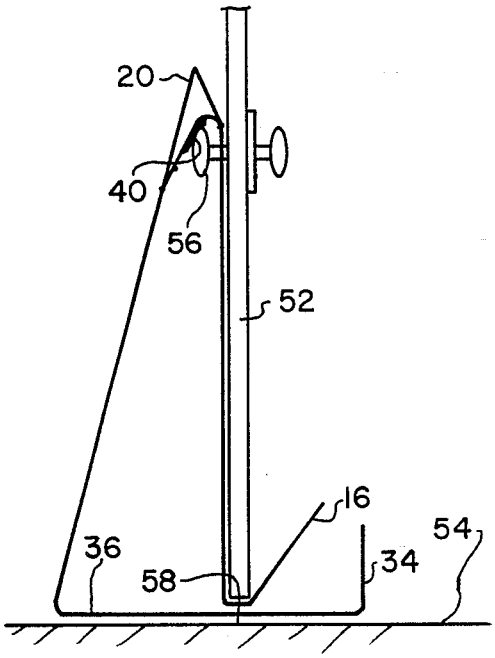
FIG. 2 is a side plan view of the door opening apparatus of FIG. 1.

The invention will now be described with respect to FIG. 1 which illustrates the door opening apparatus in accordance with this invention, generally indicated by the numeral 10. The door opening apparatus 10 includes a flexible patch member 14, a rigid member 12 which defines means for delivering the flexible patch member 14 to a door handle. The flexible patch is suspended from the rigid member in balanced relation thereto. The door opening apparatus 10 further includes control lines 16 for moving the flexible patch member 14 into unbalanced relation to the rigid member 12.

Figure 3:
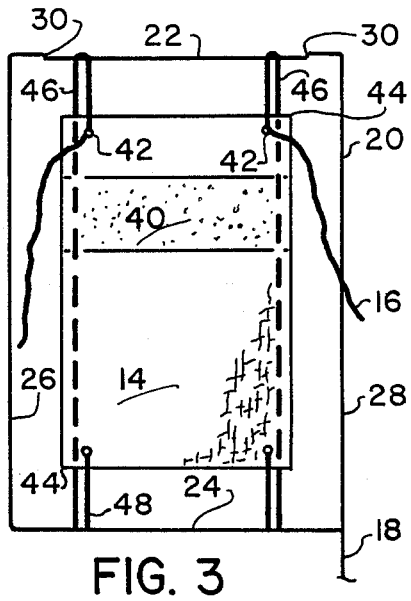
FIG. 3 is an enlarged front plan elevational view of the top section of the door opening apparatus of FIG. 1.
Figure 4:
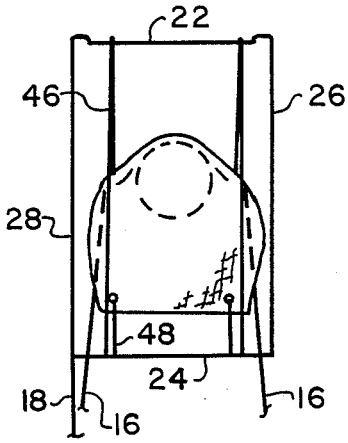
FIG. 4 is a rear plan elevational view of the top section the door opening apparatus of FIG. 1.

As is more clearly shown in FIGS. 3 and 4, the rigid member 12 includes a top section 18 having a frame 20 for the patch 14. The frame 20 is generally rectangular in shape, but the corners of the frame need not be at right angles and the opposing sides need not be of equal length. The frame 20 has a top 22 and a bottom 24 and is enclosed by sides 26 and 28.

The top 22 has detentes which define guides 30 for the control lines 16. As will be more fully appreciated with respect to the description of FIGS. 2, 4, 5 and 6, the guides 30 encourage the flexible patch member 14 to be retained on the rigid member 12 as well as facilitating the operation of the door opening apparatus 10.

While the door opening apparatus 10 is shown as being an enclosed frame 20, it will be appreciated that this is not essential to the concept of the invention. For example, the frame 20 could be an open "C"-shaped frame with side 26 being deleted. While the open "C"-shaped frame would not have the rigidity of the enclosed frame 20, for many anticipated uses, there would be sufficient rigidity for accomplishing the objects of the invention. Additionally, manufacturing and shipping costs would be less than the enclosed embodiment of the frame 20.

The rigid member 12 has a middle section 32 and a handle 34. A base leg 36 connects the middle section 32 with the handle 34 and is at approximately right angles to both. The base leg 36 being angled to the middle section 32 and handle 34 allows the user to insert the door opening apparatus 10 through the gap between the floor and the door and deliver the flexible patch member 14 to the door handle as will be appreciated more fully with respect to the discussion relative to FIGS. 2, 4, 5 and 6. The handle 34 is used for controlling and guiding the rigid member 12 under the door and to the precise location of the door handle. The handle 34 is bent at the desired angle to the base leg 36 to facilitate the locating of the flexible patch member 14 on the door handle.

The rigid member 12 may be made of any rigid material such as engineering plastic, metal or metal alloy. In the preferred embodiment, the rigid member 12 is made from steel. The rigid member 12 has a thin profile for insertion of the rigid member 12 and flexible patch through the gap between the floor and a door to be opened. Clearly, the rigid member 12 in accordance with this invention could be made exceedingly thin and still have sufficient strength to accomplish the objects as set forth herein as a result of the very efficient design of the frame 20.

The flexible patch member 14 may be made from material like cotton or any type of durable cloth or plastic material which will accept an adhesive. In the preferred embodiment, the flexible patch member 14 is made from cotton cloth. The shape of the flexible patch member 14 is generally conforming to the shape of the frame 20 and in the preferred embodiment is generally in the shape of a rectangle.

The flexible patch member 14 includes an area for grasping a door handle defining a grasping area 40. The grasping area 40 is adhered to the flexible patch. Other embodiments may have the flexible patch 14 made integral with the grasping area 40 and do not require the flexible patch 14 to be made of material which will accept an adhesive.

The grasping area 40 is especially designed for grasping a door handle. The grasping area 40 is a patch of material which is glued or otherwise adhered to the front surface of the flexible patch member 14. The grasping area 40 is located on the upper third of the flexible patch member 14 and spans the width of the flexible patch member 14 in the preferred embodiment. The grasping area 40 is made from a material having a high co-efficient of friction.

To suspend the flexible patch member 14 on the frame 20, the flexible patch member 14 is provided with openings 42 at the corners 44. The openings 42 preferably include metal reinforcing members to prevent tearing and ripping of the cotton cloth of the flexible patch member 14 and to promote durability of the overall invention.

Elastic supports 46 are threaded through the openings 42 and around the top 22 of the frame 20. The elastic supports 46 are positioned between the guides 30 and as pointed out above the detentes encourage the elastic supports 46 to stay on the frame 20, thereby maintaining the flexible patch member 14 on the rigid member 12. The elastic supports 46 are anchored to the bottom 24 of the frame 20 by simply tying each of the elastic supports 46 in a knot on the bottom 24.

Non-elastic supports 48 are used to anchor the bottom of flexible patch member 14 to the bottom 24. The non-elastic supports 48 are threaded through the bottom openings 42 of the flexible patch member 14 and anchored on the bottom 24 also by tying a knot. The nonelastic supports 48 serve to spread out the flexible patch member 14 both verically and horizontally. This assures the maximum likelihood of the grasping area 40 contacting a door handle and of doing so with the greatest ease possible.

The flexible patch member 14 is suspended on the frame 20 in as balanced a manner as possible. This means that the sides of the flexible patch member 14 are approximately equi-distance from each of the sides 26 and 28 and from the top 22 and bottom 24. This makes it easier to position the door opening apparatus 10 on the door knob from the blind side of the door. Additionally, this makes the entire upper section of the door opening apparatus 10 approximately symmetrical. As a result of this symmetry, right or left hand doors can be opened with equal ease.

The control lines 16 are threaded through top openings 42 and tied thereto. The control lines 16 may be made from string or any reasonably strong cord-like material. As the control lines 16 are pulled in a linear fashion toward the floor and away from the door handle, they are guided by the elastic supports 46 as the elastic supports 46 are guided by guides 30.

IN USE:

The use of the door opening apparatus 10 in accordance with this invention will now be discussed in detail with reference to FIGS. 2, 4, 5 and 6, although reference to the remaining FIGS., may also be helpful. The first step, of course, is to locate a door that needs to be opened. The door opening apparatus 10 is positioned for sliding the frame 20 under a gap 50 between door 52 and the floor 54. In some building structures the door gap 50 is covered by some flexible material. Since the rigid member 12 is made from a strong rigid material it is capable of bending the flexible material out of the way and going through the gap 50.

After sliding the frame 20 through the gap 50, the remaining portion of the rigid member 12 is slid through the gap 50 up to the handle 34. After the frame 20 is slide through the door way, it is rotated, approximately 90° so that the frame 20 lies in the vertical plane and the handle 34 and base leg 36 are both at ground level. Using the handle 34, the rigid member 12 is slide through the door 52 to the approximate juncture of the middle section 32 and base leg 36. Again using the handle 34, the rigid member 12 is rotated again, approximately 90°, so that the handle is elevated and flexible patch 14 is positioned adjacent a door handle 56.

Again using the handle 34, the door opening apparatus 10 is brought into contact with the door handle 56 such that the grasping area 40 is at least partially in contact with the door handle 56. Using the handle 34 the rigid member 12 can be shifted around until the distinctive feel of the grasping area 40 being in contact with the door handle 56 is felt.

Once contact is made between the grasping area 40 and the door handle 56, the control lines 16 are used to unbalance the flexible patch member 14. As shown most clearly in FIG. 2. as the control lines 16 are pulled together equally and linearly, the grasping area 40 surrounds and grasps the door handle 56. Once the door handle 56 is securely grasped, only one of the control lines is pulled linearly. The other control line is more loosely held allowing the additional tension to be exerted on the one control line. This further unbalances the flexible patch member 14. The unbalanced tension of the control lines 16 translates the linear movement of the control lines 16 to rotational movement of the door handle 56 causing the door to open.

Figure 6:
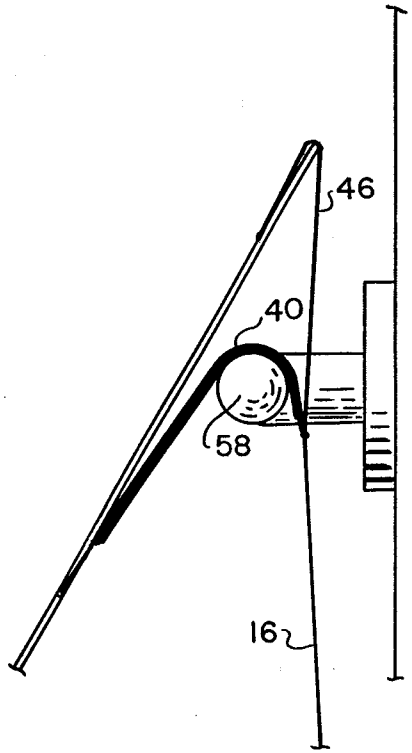
FIGS. 5 and 6 are enlarged partial sectional views of the door opening apparatus in accordance with this invention in operation with a door lever.
Figure 5:
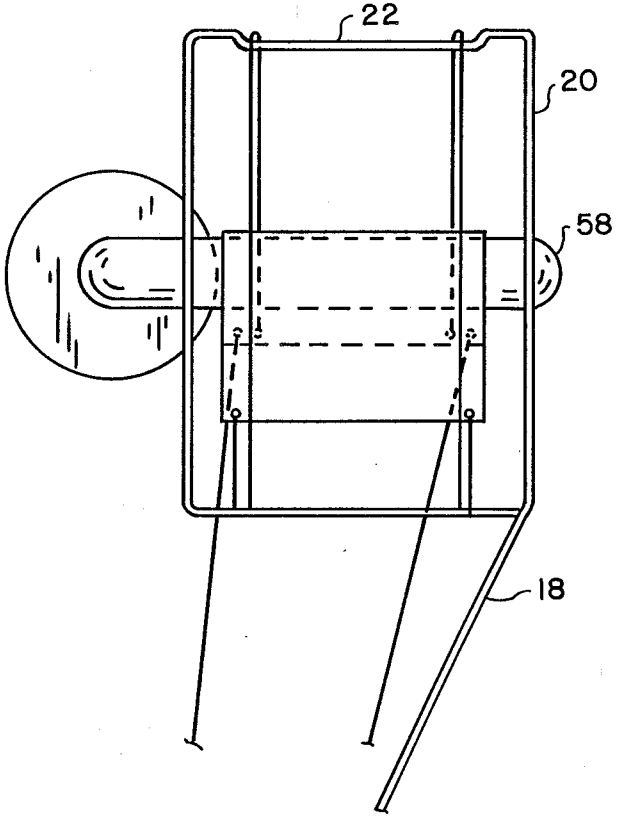

With particular reference to FIGS. 5 and 6, there is shown the door opening apparatus 10 being used with a lever-type door handle 58. The basic functioning and method of use is the same as described above with the round-type door handle 56. However, as shown clearly in FIG. 6, the control lines 16 must go behind the door handle 58.

While the foregoing detailed description has described several embodiments of the door opening apparatus in accordance with this invention, it is to be understood that the above description is illustrative only and not limiting of the disclosed invention. Particularly, various shapes of different elements have been described as well as material preferences for the preferred embodiments. It will be appreciated that other shapes and in fact, a large variety of shapes of the various elements are possible within the scope and spirit of this invention. Thus the invention is to be limited only by the claims as set forth below.

What is claimed is:

1. An apparatus for opening doors having a door handle, comprising:

a flexible patch having means for grasping the door handle;

an elongated rigid member having a top portion defining a frame having at least three sides, the flexible patch suspended within the frame and in balanced relation thereto: and means connected to the patch for unbalancing the patch on the frame and for translating linear movement of the patch into rotational movement of the door handle.

2. An apparatus for opening doors as set forth in claim 1, wherein, a balanced relation is defined as the patch being approximately equally spaced from the inside of the frame.

3. An apparatus for opening doors as set forth in claim 1, wherein means for grasping comprises a patch of material having a high co-efficient of friction adhered to the flexible patch.

4. An apparatus for opening doors as set forth in claim 3, wherein the material has a high co-efficient of friction.

5. An apparatus for opening doors as set forth in claim 1, wherein the rigid member has a thin profile and no more than ¼".

6. An apparatus for opening doors as set forth in claim 1, wherein the frame defines a "C" shape.

7. An apparatus for opening doors as set forth in claim 1, wherein the frame defines an enclosed shape.

8. An apparatus for opening doors as set forth in claim 1, wherein the frame has a top and the top has guide means for guiding the control means.

9. An apparatus for opening doors as set forth in claim 1, wherein the top section of the apparatus is symmetrical.

10. An apparatus for opening doors as set forth in claim 1, wherein the control means includes two control lines, each connected to the upper section of the flexible patch and wherein pulling one of the control lines unbalances the patch.

11. An apparatus for opening doors as set forth in claim 1, wherein the patch is suspended from the frame by elastic supports being threaded through openings in the patch and being wrapped around the frame and anchored thereto.

12. An apparatus for opening doors as set forth in claim 11, wherein non-elastic supports attached to the frame and the patch spread out the patch on the frame encouraging maximum likelihood of contact with the door handle.

13. For opening locked doors having a door handle, an apparatus comprising:

a flexible patch having means for grasping the door handle;

an elongated rigid member having a top portion defining a frame having at least three inside sides, a bent middle section and a handle, the flexible patch suspended within the frame and in balanced relation thereto, such that the patch is approximately equally spaced from the inside of the frame; and control means connected to the patch for unbalancing the patch on the frame and for translating linear movement of the patch into rotational movement of the door handle, whereby upon linear movement of the control means, a door knob in contact with the patch will rotate.

14. A method of using a door opening apparatus for opening doors having a handle, the steps comprising:

providing a door opening apparatus as set forth in claim 13;

inserting the frame of the door opening apparatus in a gap between the door to be opened and the floor;

rotating the door opening apparatus using the handle to position the flexible portion adjacent the door handle;

contacting the door handle with the means for grasping by shifting the door opening apparatus using the control means and the handle; and rotating the door handle by linear movement of the control means away from the door handle and towards the floor.

15. A method of opening a door as set forth in claim 14, wherein the control means comprises two control lines and wherein the step of rotating includes initially moving both lines together for grasping the door handle securely and then causing rotation of the door handle by linear movement of only one of the control line away from the door handle.

16. A method of opening a door as set forth in claim 14, wherein the door opening apparatus is rotated twice and wherein the elongated frame includes a middle section connected to the frame and a handle lying in approximately the same plane with a base leg connecting the middle section and the handle approximately perpendicular to both, the first rotation occurring just after the frame has been inserted through the door and the second occurring when the middle section is in close proximity to the door.

* * * * *